US011602659B2

(12) United States Patent
Lo

(10) Patent No.: US 11,602,659 B2
(45) Date of Patent: Mar. 14, 2023

(54) LOADING DEVICE FOR AN EXERCISE MACHINE

(71) Applicant: TUNG KENG ENTERPRISE CO., LTD., Taichung (TW)

(72) Inventor: Chiu-Hsiang Lo, Taichung (TW)

(73) Assignee: TUNG KENG ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 17/362,999

(22) Filed: Jun. 30, 2021

(65) Prior Publication Data

US 2023/0001254 A1 Jan. 5, 2023

(51) Int. Cl.
*A63B 21/00* (2006.01)
*A63B 21/008* (2006.01)

(52) U.S. Cl.
CPC .... *A63B 21/00072* (2013.01); *A63B 21/0083* (2013.01); *A63B 21/154* (2013.01)

(58) Field of Classification Search
CPC ..... A63B 21/00072; A63B 21/0083; A63B 21/154; A63B 21/159; A63B 21/0087; A63B 21/155–156; A63B 21/0058; A63B 21/00069; A63B 21/00076; A63B 21/008; A63B 21/0085; A63B 21/15; A63B 21/151; A63B 21/4045; A63B 22/20; A63B 22/201; A63B 2022/206
See application file for complete search history.

(56) References Cited

U.S. PATENT DOCUMENTS 4,607,841 A * 8/1986 Gala ..... A63B 21/002 73/379.06
5,312,313 A * 5/1994 Holmes ..... A63B 23/12 482/95
5,472,407 A * 12/1995 Schenck ..... A61H 1/0288 601/40
5,499,959 A * 3/1996 Holmes ..... A63B 23/12 482/93
5,624,353 A * 4/1997 Naidus ..... A63B 21/0628 482/137
6,074,328 A * 6/2000 Johnson ..... A63B 21/4035 482/137

(Continued)

FOREIGN PATENT DOCUMENTS

DE 3541980 A1 * 6/1987 ..... A63B 21/023
KR 20020086407 A * 11/2002 ..... A63B 21/154
WO WO-9408663 A1 * 4/1994 ..... A63B 21/00076

*Primary Examiner* — Gary D Urbiel Goldner
(74) *Attorney, Agent, or Firm* — Bruce Stone LLP; Joseph A. Bruce

(57) ABSTRACT

An exercise machine is provided with a loading device. The loading device includes a lever, a coupler, a cylinder unit and a driving unit. The lever includes two ends. The first end of the lever is connected to the exercise machine. The coupler is movable along the lever between the first and second ends. The cylinder unit includes an end connected to the exercise machine and another end connected to the coupler. The driving unit includes a threaded sleeve, a threaded rod and a motor. The threaded sleeve is connected to the coupler. The threaded rod is engaged with the threaded sleeve. The motor rotates the threaded rod relative to the threaded sleeve so that the threaded rod moves the coupler via the threaded sleeve.

6 Claims, 10 Drawing Sheets

(56) References Cited

U.S. PATENT DOCUMENTS

| | | | | |
|---|---|---|---|---|
| 7,278,958 | B2 * | 10/2007 | Morgan | A63B 21/00065 482/99 |
| 7,758,479 | B2 | 7/2010 | Husted | |
| 9,415,293 | B1 * | 8/2016 | Wang | A63B 21/0087 |
| 9,468,788 | B2 * | 10/2016 | Bissu | A63B 21/00072 |
| 2004/0254050 | A1 * | 12/2004 | Morgan | A63B 21/00065 482/121 |
| 2006/0019807 | A1 * | 1/2006 | Husted | A63B 21/00069 482/121 |
| 2007/0142187 | A1 * | 6/2007 | Kolomeir | A63B 21/0083 482/92 |
| 2015/0238801 | A1 * | 8/2015 | Meredith | A63B 21/0628 482/98 |
| 2016/0121156 | A1 * | 5/2016 | Bach | A63B 21/4009 482/112 |

* cited by examiner

LOADING DEVICE FOR AN EXERCISE MACHINE

BACKGROUND OF INVENTION

1. Field of Invention

The present invention relates to an exercise machine and, more particularly, to a loading device for use on an exercise machine.

2. Related Prior Art

An exercise machine includes a loading device operable to control a load or resistance against a person who exercises with the exercise machine. The loading device can include a spring, a set of weights or a system of levers.

Where a loading device includes a spring, it is impossible for a user to adjust the load provided by the spring because the load provided by the spring gets heavier as extension of the spring gets longer.

Where a loading device includes a set of weights, a user is allowed to adjust the load by using different combinations of the weights. However, the adjustment of the load is not delicate for two reasons. Firstly, each of the weights is made with a considerable weight. Secondly, the number of the combinations is limited.

As disclosed in U.S. Pat. No. 7,758,479 for example, an exercise machine is provided with a left loading device and a right loading device. The left and right loading devices are identical to each other in structure and are mirror images to each other in position. For the briefness of the description, only the left loading device will be described. The left loading device includes a lever 30, two pulleys 34 and 70, a pneumatic cylinder 36, a cable 40 and a coupling device 50. The lever 30 includes multiple holes 42 arranged along the lever 30. A pivot 32 is used to connect an end of the lever 30 to an upright member 14 of the exercise machine. The pulley 34 is supported on the lever 30, near another end of the lever 30. The pulley 70 is attached to a lower support member 16 of the exercise machine. The cable 40 is wound on the pulleys 34 and 70. An end of the cable 40 is tied to a lower support member 16 of the exercise machine. Another end of the cable 40 is tied to a handle 44 to be held by a user. The coupling device 50 includes a body 52 and a handle 54. The body 52 is supported on the lever 30. The handle 54 is formed with a pin 54*a* and a flange 54*d*. A spring 54*b* is compressed between the flange 54*d* and an internal portion of the body 52. An upper end of the pneumatic cylinder 36 is pivotally connected to the body 52. A pivot 38 is used to connect a lower end of the pneumatic cylinder 36 to the lower support member 16. The distance between the pivot 32 and the upper end of the pneumatic cylinder 36 sets a first moment arm while the distance between the pivot 32 and a center of the rollers 34 sets a moment arm. The body 52 is movable on the lever 30 so that the first moment arm is adjustable. In use, the pin 54*a* is inserted in a selected one of the holes 42 to keep the upper connected end of the pneumatic cylinder 36 in a selected one of multiple positions relative to the pivot 32, i.e., keep the first moment arm in a selected one of multiple values. The spring 54*b* keeps the while pin 54*a* in the selected hole 42 and retains two contact portions 53 of the body 52 against the lever 30.

The use of the loading devices is not without any problem. The sliding of the body 52 on the lever 30 and the insertion of the pin 54*a* in one of the holes 42 are manual. Hence, the use of the loading devices is not convenient. Moreover, the use of the handle 54 to keep the upper end of the pneumatic cylinder 36 in position relative to the pivot 32 is not firm.

The present invention is therefore intended to obviate or at least alleviate the problems encountered in the prior art.

SUMMARY OF INVENTION

It is the primary objective of the present invention to provide an exercise machine with a delicately adjustable loading device.

To achieve the foregoing objective, the loading device includes a lever, a coupler, a cylinder unit and a driving unit. The lever includes two ends. The first end of the lever is connected to the exercise machine. The coupler is movable along the lever between the first and second ends. The cylinder unit includes an end connected to the exercise machine and another end connected to the coupler. The driving unit includes a threaded sleeve, a threaded rod and a motor. The threaded sleeve is connected to the coupler. The threaded rod is engaged with the threaded sleeve. The motor rotates the threaded rod relative to the threaded sleeve so that the threaded rod moves the coupler via the threaded sleeve.

Other objectives, advantages and features of the present invention will be apparent from the following description referring to the attached drawings.

BRIEF DESCRIPTION OF DRAWINGS

The present invention will be described via detailed illustration of two embodiments referring to the drawings wherein.

DETAILED DESCRIPTION OF EMBODIMENTS

Figure 1:
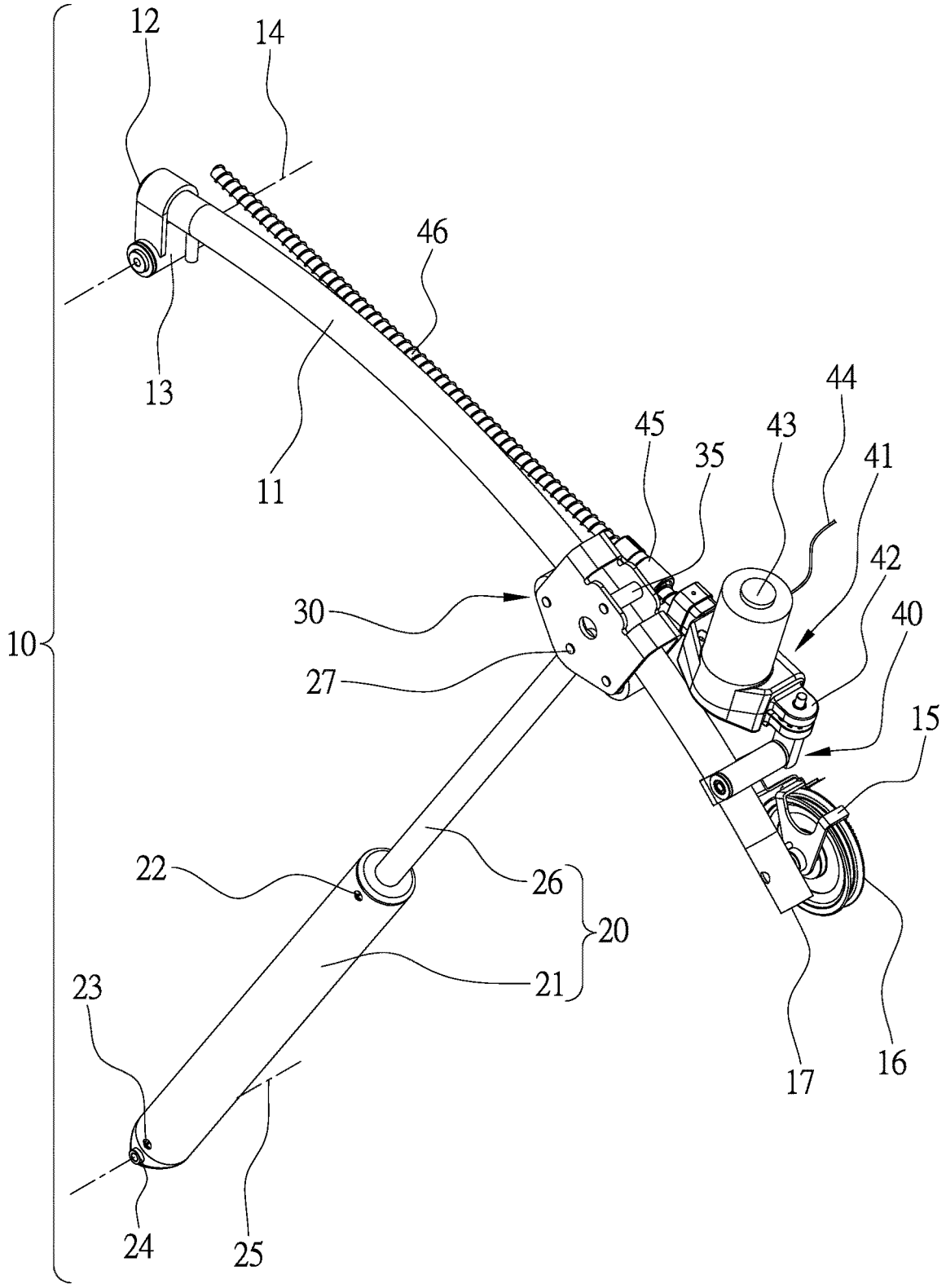
FIG. 1 is a perspective view of a loading device according to the first embodiment of the present invention.

Referring to FIG. 1, a loading device 10 includes a lever 11, a cylinder unit 20, a coupler 30 and a driving unit 41 according to a first embodiment of the present invention. The loading device 10 can be used with an exercise machine 50 shown in FIG. 9 or another exercise machine 60 shown in FIG. 10.

The lever 11 is an arched element formed with two ends 12 and 17. A pivot 13 is used to connect the end 12 of the lever 11 to a portion of the exercise machine 50 or 60 so that the lever 11 is allowed to pivot about an axis 14 along which the pivot 13 extends. A supporting element 15 and a positioner 40 are connected to the lever 11, near the end 17. The supporting element 15 supports a stationary pulley 16. A cable 57 (FIG. 9) or another cable 65 (FIG. 10) is wound on the stationary pulley 16 so that the stationary pulley 16 is subjected to a force F exerted by the cable 57 or 65. The positioner 40 includes two portions extending perpendicular to each other. The portions of the positioner 40 are pivotally connected to each other. The first portion of the positioner 40 is connected to the lever 11. Preferably, the first portion of the positioner 40 is a ferrule extending around the lever 11. Alternatively, the first portion of the positioner 40 is connected to the lever 11 by welding. The second portion of the positioner 40 is connected to the driving unit 41. The driving unit 41 is located behind the lever 11.

Figure 7:
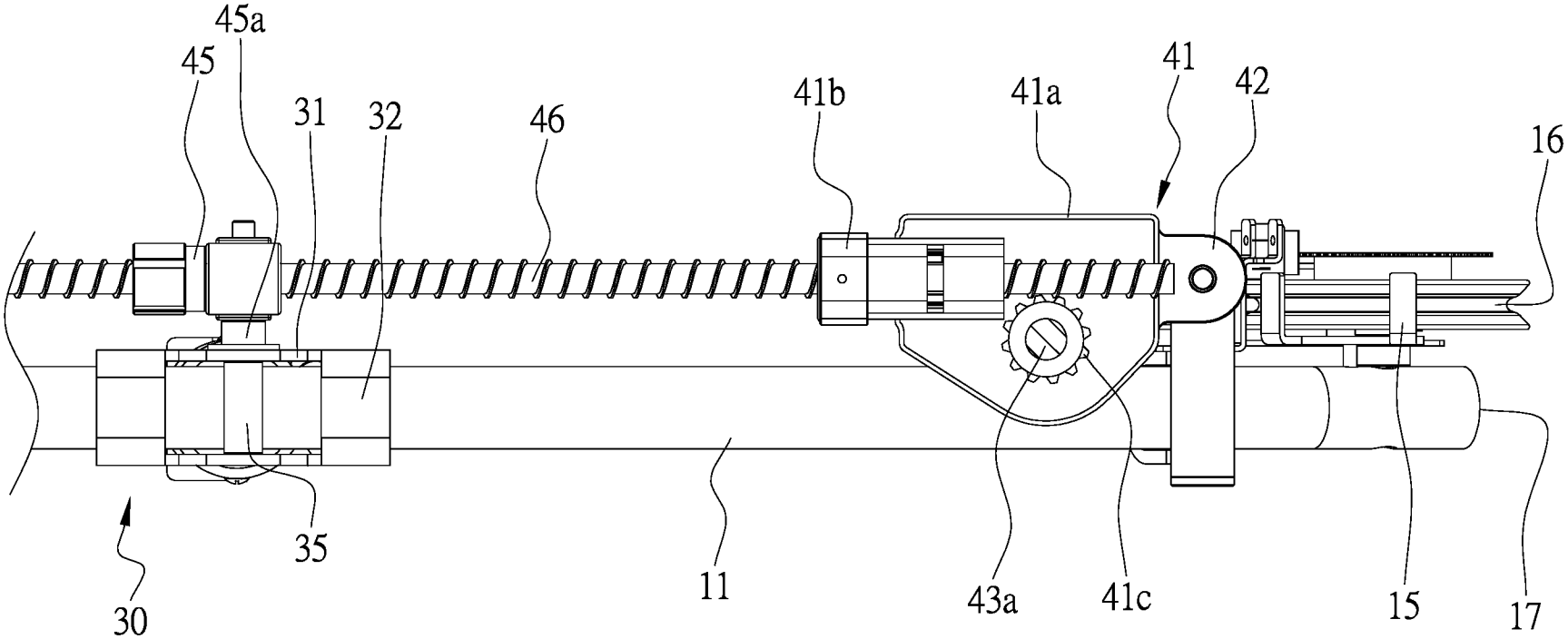
FIG. 7 is an enlarged, partial and cross-sectional view of the loading device shown in FIG. 2.

The driving unit 41 includes a shell 41*a* (FIG. 7), a motor 43, a threaded sleeve 45 and a threaded rod 46. The shell 41*a* is pivotally connected to the second portion of the positioner 40. The motor 43 is supported on the shell 41*a*. The motor 43 is electrically connected to a power supply (not shown) through a wire 44. The motor 43 includes a mandrel 43*a* (FIG. 7). The power supply is used to energize the motor 43 to rotate the mandrel 43*a*. The threaded rod 46 is operatively connected to the mandrel 43*a* so that the threaded rod 46 is rotated by the mandrel 43*a*. The threaded sleeve 45 is engaged with the threaded rod 46 so that the threaded sleeve 45 moves on and along the threaded rod 46 when the threaded rod 46 rotates.

Figure 2:
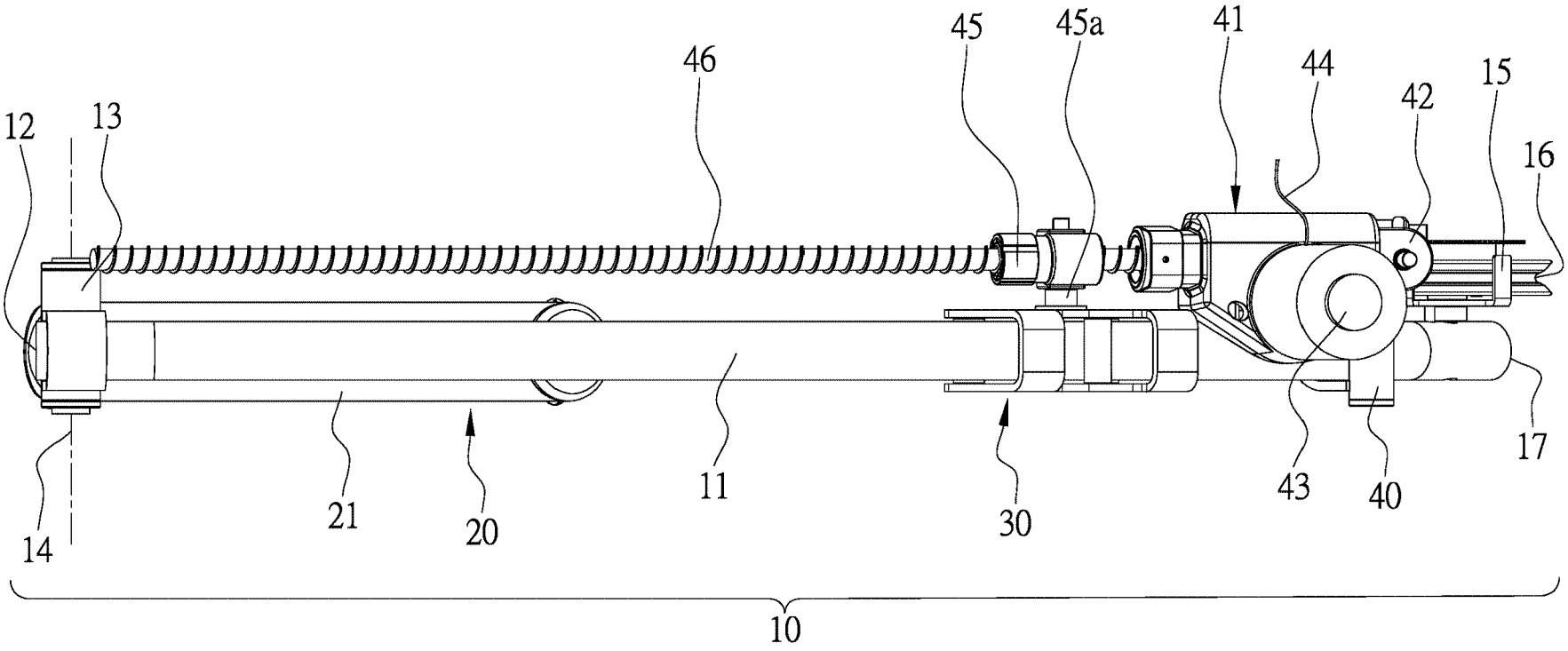
FIG. 2 is a top view of the loading device shown in FIG. 1.

Referring to FIG. 2, the shell 41*a* is formed with a connective portion 42 pivotally connected to the second portion of the positioner 40 so that the driving unit 41 is pivotally connected to the lever 11, in the vicinity of the supporting element 15. The threaded sleeve 45 is connected to the coupler 30 by a pivot 45*a*. The coupler 30 is movable on and along the lever 11 between the end 12 of the lever 11 and the end 17 of the lever 11 (or the positioner 40). The threaded sleeve 45 is prevented from rotation about an axis of the threaded rod 46 but allowed to move along the axis of the threaded rod 46 due to the pivot 45*a*, which is connected to the coupler 30.

Referring to FIG. 7, a toothed wheel 41*c* is located in and connected to the shell 41*a*. The toothed wheel 41*c* is coaxially connected to the mandrel 43*a*. The toothed wheel 41*c* is engaged with the threaded rod 46 so that the toothed wheel 41*c* rotates the threaded rod 46. A supporting element 41*b* is located in and connected to the shell 41*a*. The supporting element 41*b* is in the form of a collar or sleeve extending around the threaded rod 46 so that the supporting element 41*b* keeps the threaded rod 46 engaged with the toothed wheel 41*c*.

The motor 43 can be energized to rotate the mandrel 43*a*. The mandrel 43*a* rotates the toothed wheel 41*c*. The toothed wheel 41*c* rotates the threaded rod 46. The threaded rod 46 moves the threaded sleeve 45. The coupler 30 moves with the threaded sleeve 45. Thus, the coupler 30 can be located in the vicinity of the end 17 of the lever 11 (FIG. 2) or moved toward the end 12 of the lever 11 (FIG. 4).

Referring to FIG. 1 again, the cylinder unit 20 can be a pneumatic or hydraulic cylinder unit that includes a cylinder 21 and a plunger 26. The cylinder 21 is formed with a lug 24 at an end. The plunger 26 includes a first end movable in the cylinder 21 and a second end movable in the exterior of the cylinder 21. Gas or liquid can be admitted into the cylinder 21 through an aperture 22 to move the second end of the plunger 26 toward the cylinder 21. Gas or liquid can be admitted into the cylinder via another aperture 23 to move the second end of the plunger 26 from the cylinder 21. The second end of the plunger 26 is formed with a lug 28 (FIG. 6) connected to the coupler 30 by a fastener 27 such as a rivet and a combination of a threaded bolt with a nut. The cylinder unit 20 pivots about an axis 25 extending through the lug 24 when the coupler 30 moves along the lever 11.

Figure 6:
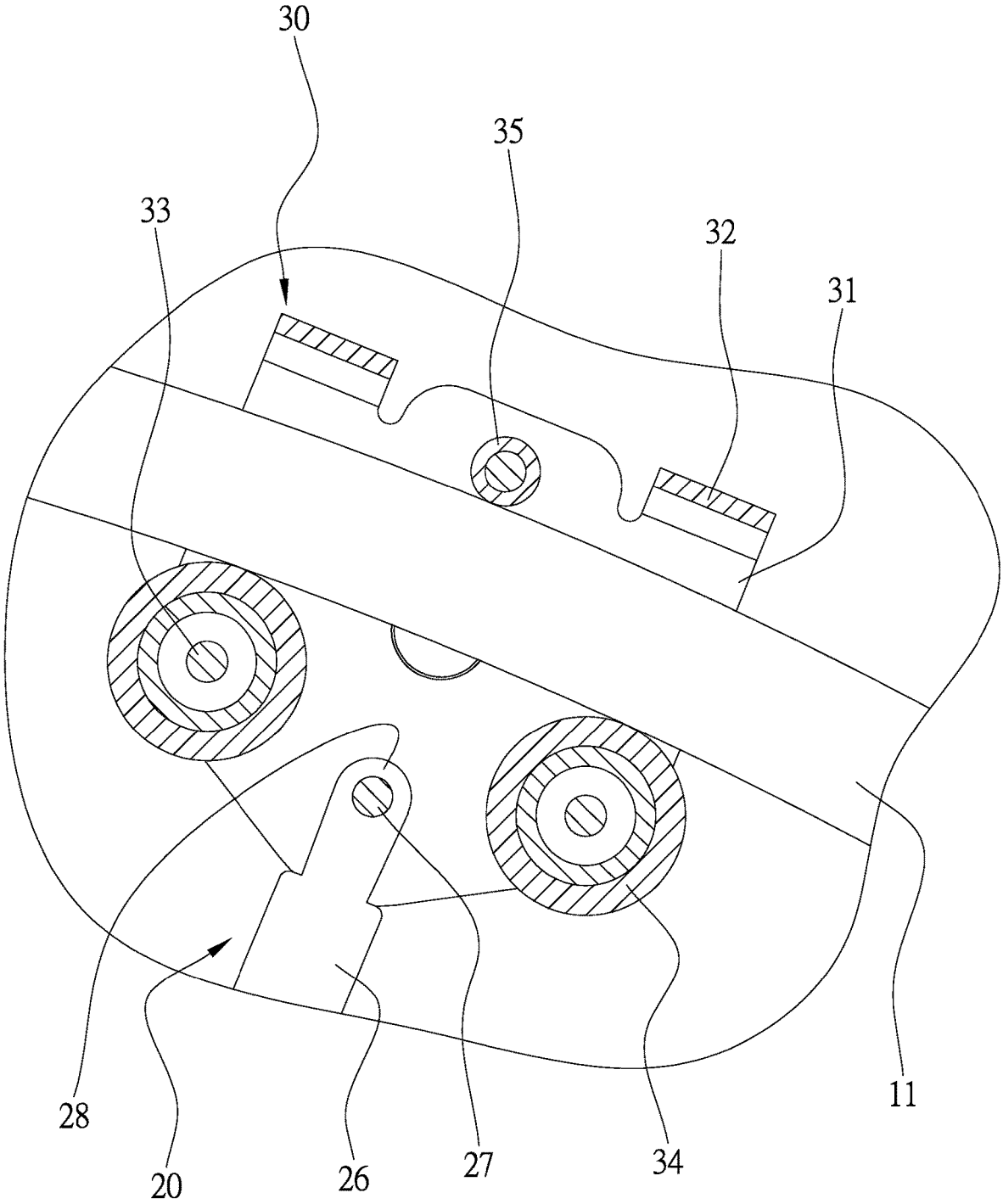
FIG. 6 is an enlarged, partial and cross-sectional view of the loading device shown in FIG. 3.

Referring to FIG. 6, the coupler 30 includes two arched portions 32 formed between two planar portions 31. The second end of the plunger 26 is located between the planar portions 31 of the coupler 30 before the former is connected to the latter via the fastener. Two rollers 34 and a roller 35 are located between the planar portions 31 of the coupler 30 before the former are connected to the planar portions 31 of the coupler 30 by fasteners 33. The rollers 34 are located further from the arched portions 32 of the coupler 30 than the roller 35 is. The second end of the plunger 26 is located between the rollers 34. The lever 11 is located between the planar portions 31 of the coupler 30. The lever 11 is not in contact with the plunger 26. The rollers 34 are in contact with a side of the lever 11 while the roller 35 is in contact with another side of the lever 11. The rollers 34 and 35 allow the coupler 30 to move smoothly on and along the lever 11.

Figure 3:
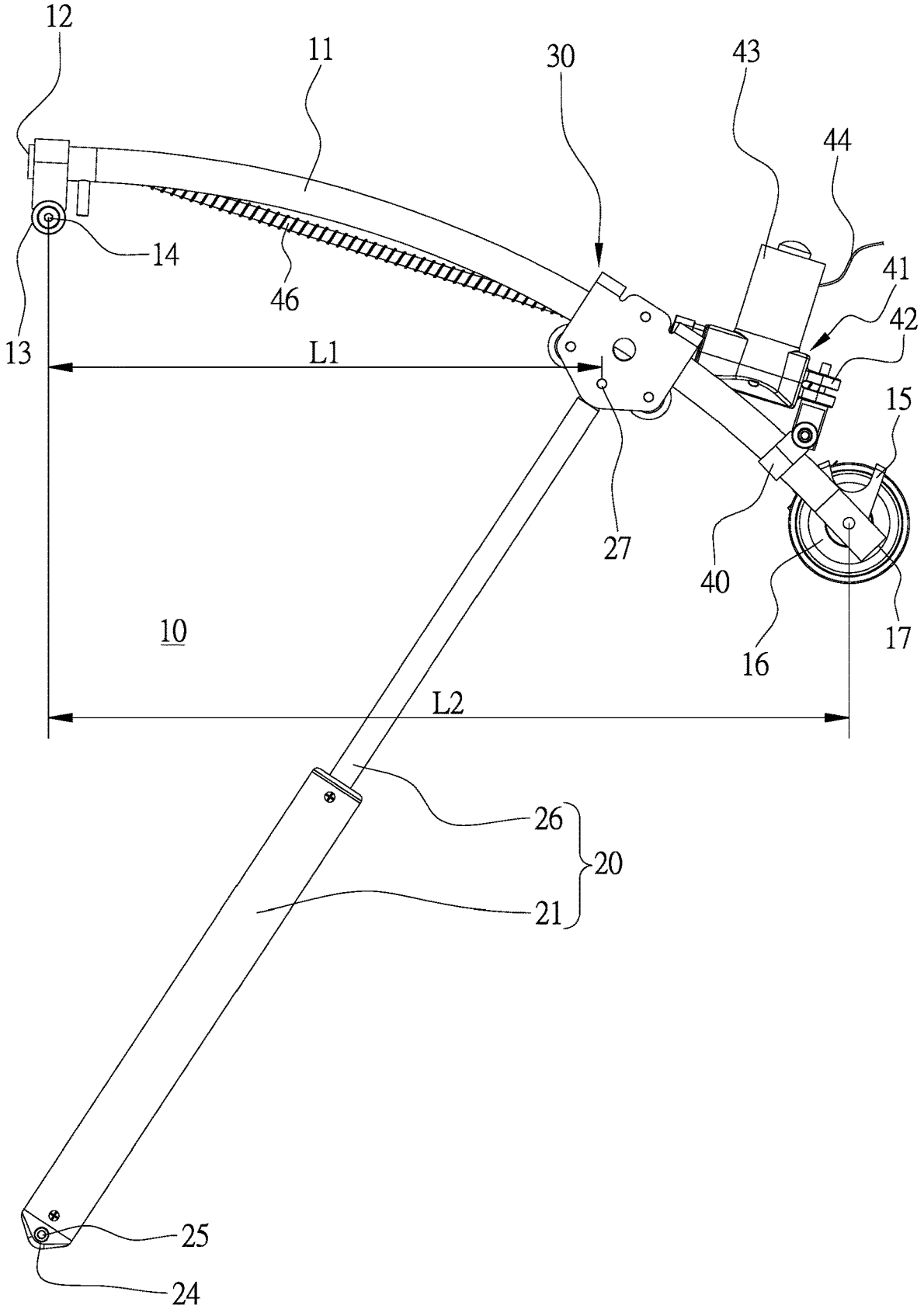
FIG. 3 is a front view of the loading device shown in FIG. 2.
Figure 4:
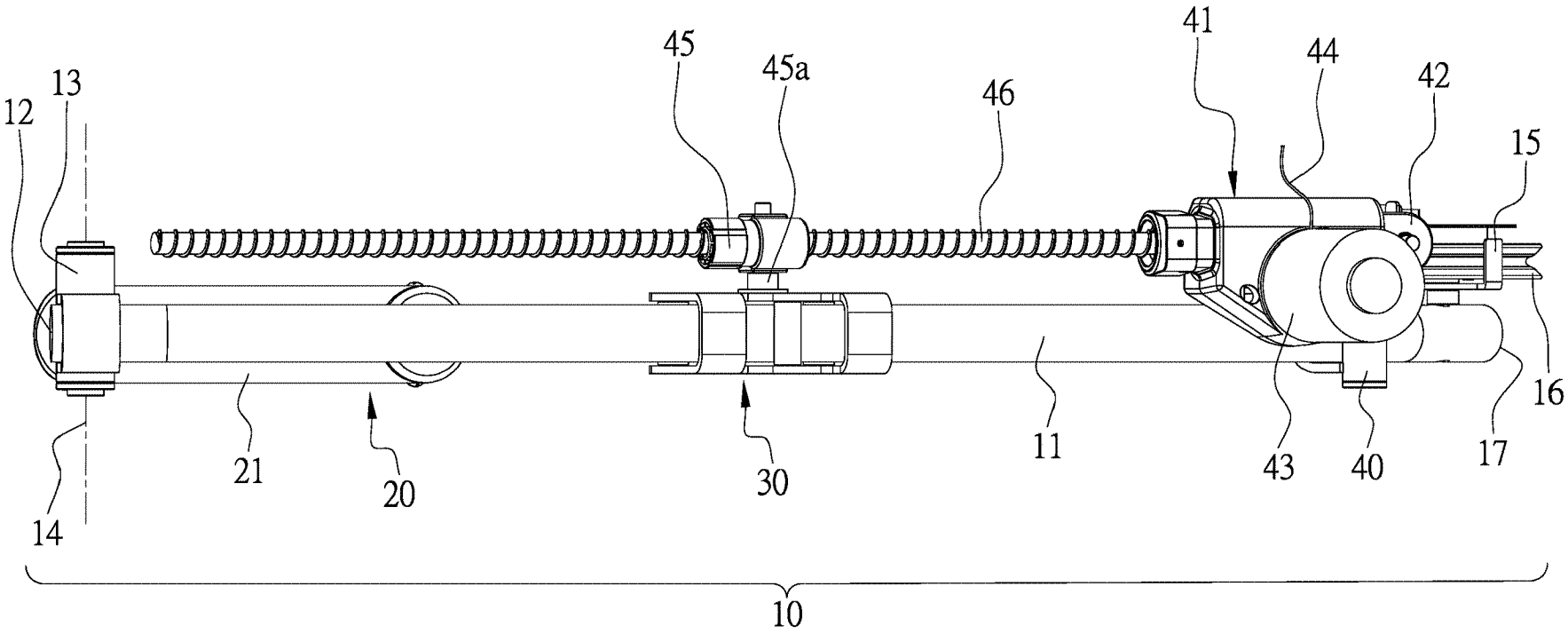
FIG. 4 is a top view of the loading device in another position than shown in FIG. 2.
Figure 5:
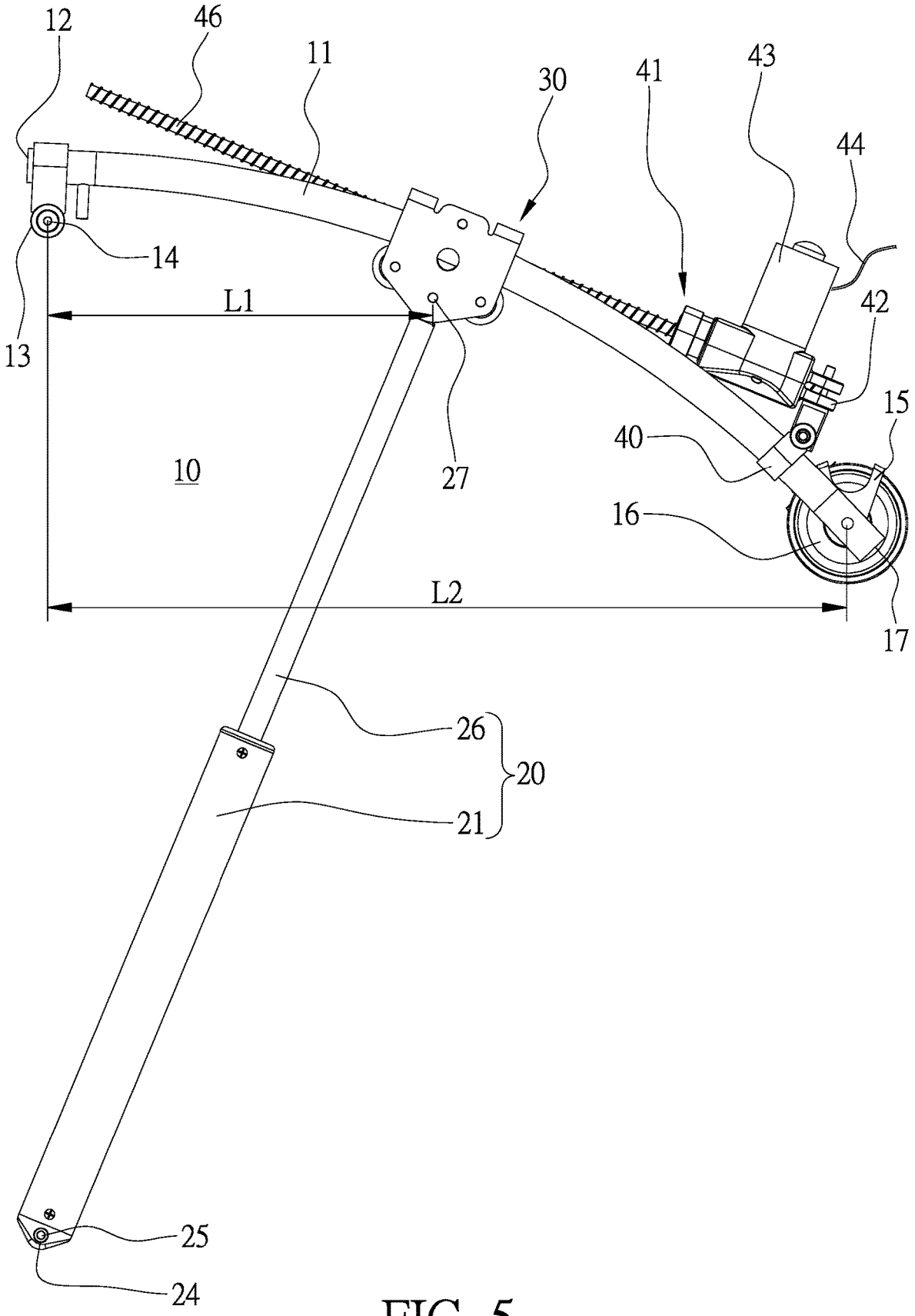
FIG. 5 is a front view of the loading device shown in FIG. 4.

Referring to FIGS. 2 through 5, a first moment arm is determined by the distance between the axis 14 and an axis (not numbered) of the pulley 16. The first moment arm is constant because the pulley 16 is not movable in relation to the lever 11. A second moment arm is determined by the distance between the axis 14 and an axis (not numbered) of the fastener 27. The second moment arm is adjustable because the coupler 30 is movable along the lever 11. For example, the second moment arm shown in FIGS. 2 and 3 is longer than the second moment arm shown in FIGS. 4 and 5. Hence, a user of the exercise machine 50 or 60 encounters a larger resistance when the second moment arm is as shown in FIGS. 2 and 3 than as shown in FIGS. 4 and 5.

Figure 8:
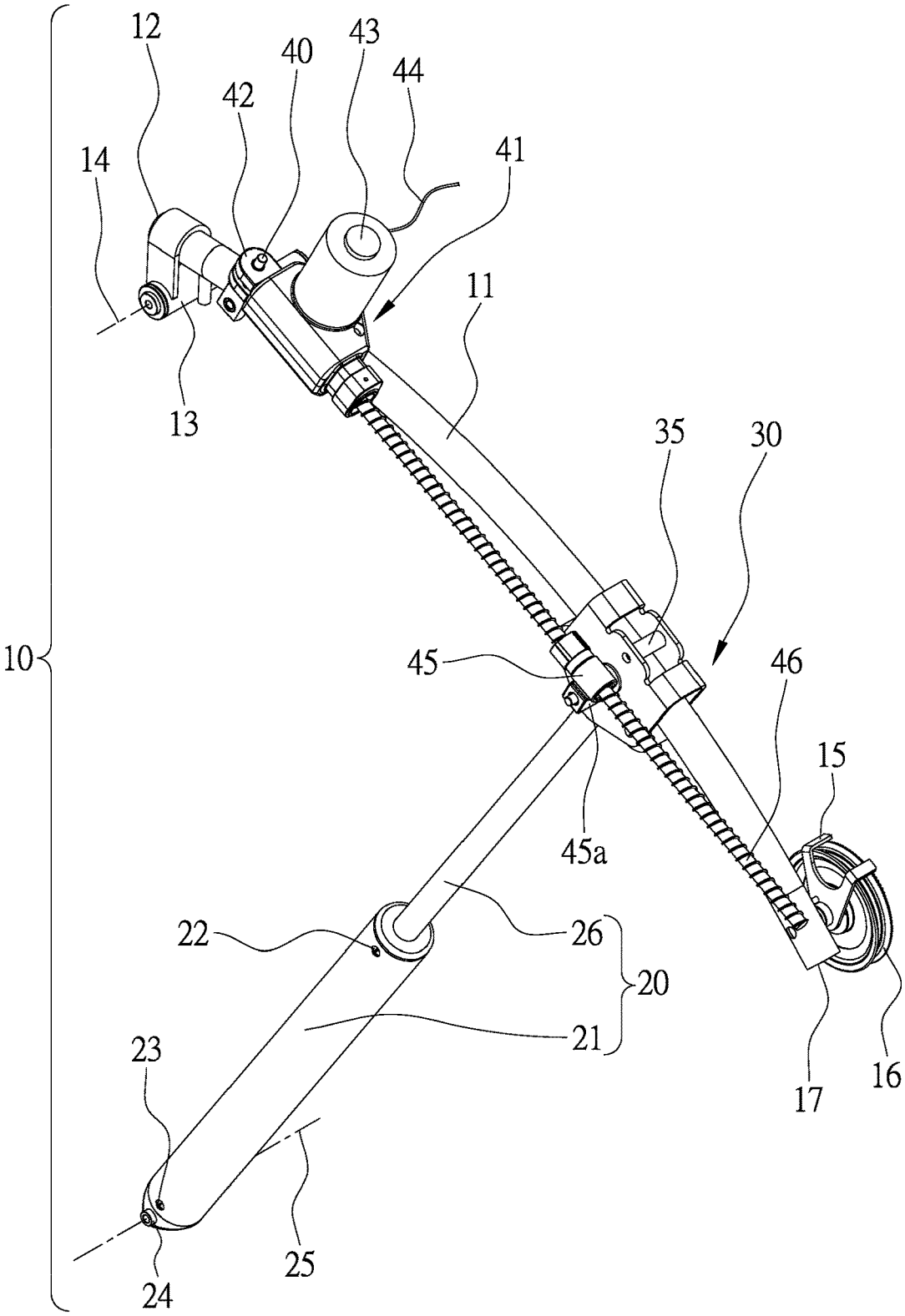
FIG. 8 is a perspective view of a loading device according to the second embodiment of the present invention.

Referring to FIG. 8, there is a loading device 10 according to a second embodiment of the present invention. The second embodiment is like the first embodiment except for that the driving unit 41 is located in the vicinity of the end 12 of the lever 11. Accordingly, the driving unit 41 is located in front the lever 11.

Figure 9:
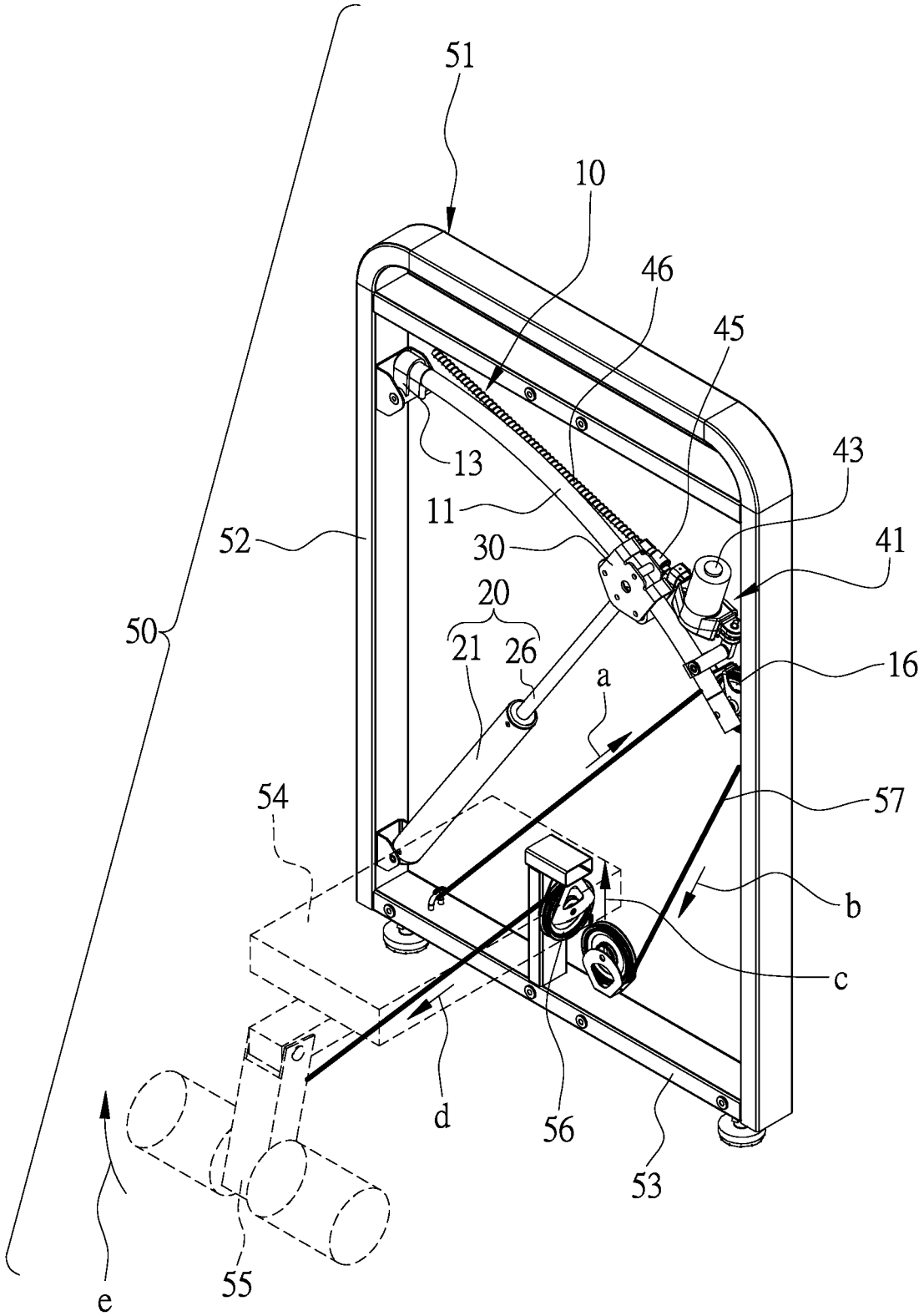
FIG. 9 is a perspective view of an exercise machine equipped with the loading device shown in FIG. 1.

Referring to FIG. 9, the exercise machine 50 is equipped with the loading device 10. The exercise machine 50 further includes a frame 51, a bench 54, a pivotal element 55, a pulley set 56 and a cable 57. The frame 51 includes two vertical bars 52 connected to two horizontal bars 53. The bench 54 is located before and connected to the frame 51. The pivotal element 55 is located below and pivotally connected to the bench 54. The pulley set 56 is located in and connected to the frame 51.

The loading device 10 is located in the frame 51, behind the bench 54. The end 12 of the lever 11 is connected to a left one of the vertical bars 52 via the pivot 13, in the vicinity of an upper end. The lug 24 of the cylinder 21 is connected to the left vertical bar 52 by a pivot (not numbered), in the vicinity of a lower end.

The cable 57 is wound on the pulley set 56 and the pulley 16. An end of the cable 57 is tied to a rear face of the pivotal element 55. Another end of the cable 57 is tied to a lower one of the horizontal bars 53.

A user of the exercise machine 50 sits on the bench 54. The user bends his or her legs before hooking the pivotal element 55 with the legs. Then, the user stretches the legs and pivots the pivotal element 55 from the bench 54 as indicated by an arrow head e. Hence, the user encounters a resistance from the loading device 10 via the cable 57 as indicated by arrow heads a, b, c and d.

Figure 10:
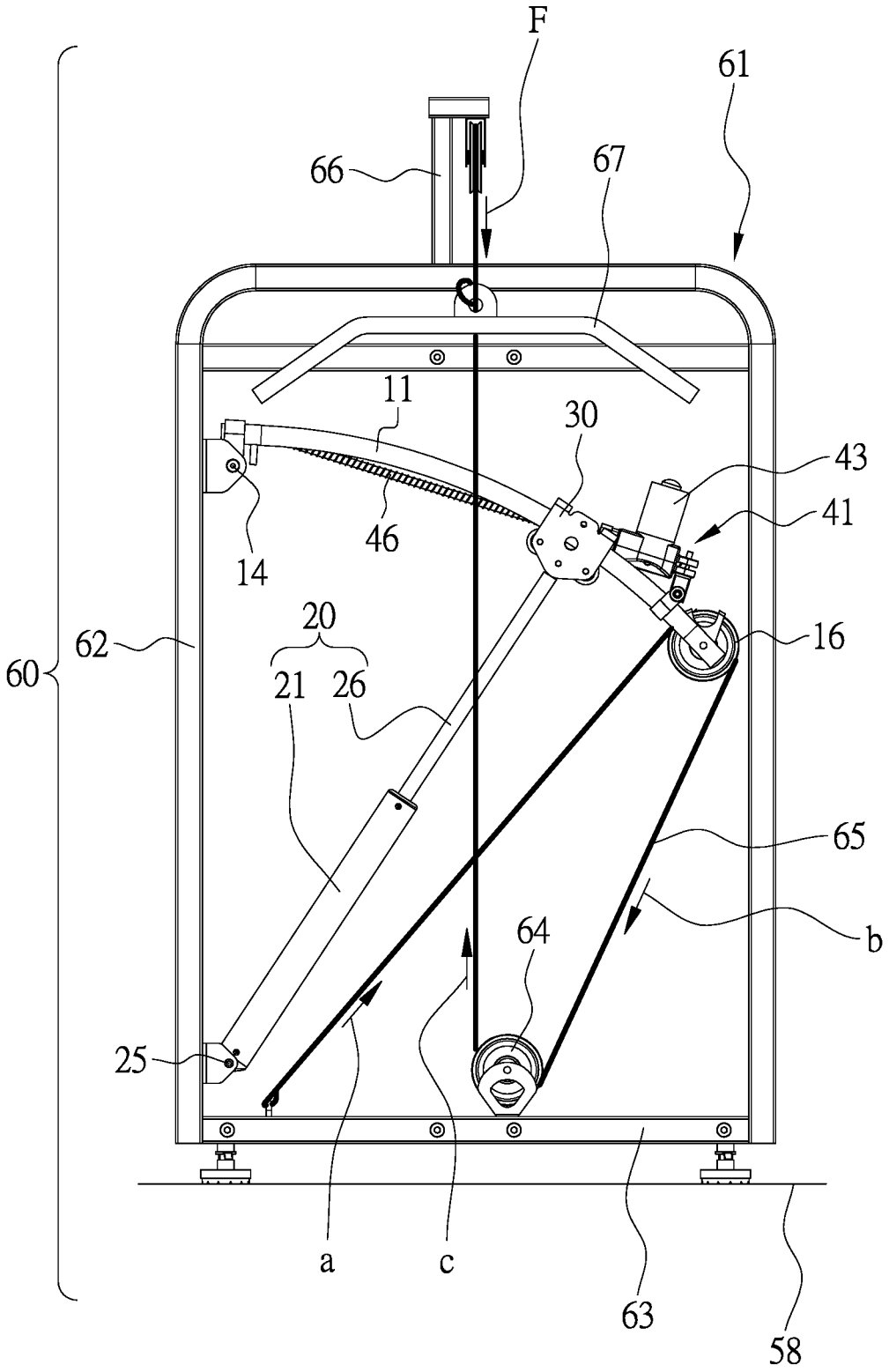
FIG. 10 is a perspective view of another exercise machine equipped with the loading device shown in FIG. 1.

Referring to FIG. 10, the exercise machine 60 is equipped with the loading device 10. The exercise machine 60 further includes a primary frame 61, a pulley set 64, a cable 65, a secondary frame 66 and a handle 67. The primary frame 61 includes two vertical bars 62 connected to two horizontal bars 63. The primary frame 61 is located on a supporting surface 58 such as a floor. The pulley set 64 is located in and connected to the primary frame 61. The secondary frame 66 is connected to an upper one of the horizontal bars 63.

The loading device 10 is located in the frame 51. The end 12 of the lever 11 is connected to a left one of the vertical bars 62 via the pivot 13, in the vicinity of an upper end. The lug 24 of the cylinder 21 is connected to the left vertical bar 52 by a pivot (not numbered) extending along the axis 25, in the vicinity of a lower end.

The cable 65 is wound on the pulley set 64 and the pulley 16. An end of the cable 65 is tied to a middle portion of the handle 67. Another end of the cable 65 is tied to a lower one of the horizontal bars 63.

A user of the exercise machine 60 stands in front of the primary frame 61. The user stretches his or her arms before holding the handle 67 with his or her hands. Then, the user bends the arms and pulls the handle 67 from the secondary frame 66 as indicated by an arrow head f. Hence, the user encounters a resistance from the loading device 10 via the cable 65 as indicated by arrow heads a, b and c.

The present invention has been described via the illustration of the embodiments. Those skilled in the art can derive variations from the embodiments without departing from the scope of the present invention. Therefore, the embodiments shall not limit the scope of the present invention defined in the claims.

The invention claimed is:

1. A loading device for use in an exercise machine, wherein the loading device comprises:

a lever comprising a first end and a second end, wherein the first end of the lever is configured to be connected to the exercise machine;

a coupler comprising:

a frame comprising two planar portions and two arched portions between the two planar portions, wherein all the planar and arched portions are formed in one piece;

two lower rollers supported on the two planar portions under the two arched portions; and an upper roller supported on the two planar portions under the two arched portions;

wherein the two lower rollers are rollable along a lower side of the lever while the upper roller is rollable along an upper side of the lever so that the coupler is smoothly movable along the lever between the first and second ends;

a cylinder unit comprising an end configured to be connected to the exercise machine and another end connected to the coupler; and a driving unit comprising:

a positioner comprising a first portion connected to the lever and a second portion pivotally connected to the first portion;

a shell comprising a connective portion pivotally connected to the second portion of the positioner;

a threaded sleeve connected to the frame of the coupler;

a threaded rod engaged with the threaded sleeve; and a motor located in the shell and operable for rotating the threaded rod relative to the threaded sleeve so that the threaded rod moves the coupler via the threaded sleeve.

2. The loading device according to claim 1, wherein the driving unit further comprises:

a toothed wheel located in the shell and driven by the motor; and a supporting element located in the shell, wherein the supporting element keeps the threaded rod engaged with the toothed wheel.

3. The loading device according to claim 2, wherein the motor comprises a mandrel coaxially connected to the toothed wheel.

4. The loading device according to claim 1, wherein the lever is an arched element.

5. The loading device according to claim 1, further comprising a stationary pulley connected to the lever, in a vicinity of the second end of the lever.

6. The loading device according to claim 1, wherein the cylinder unit includes a cylinder and a plunger extending from the cylinder, wherein the cylinder comprises a lug configured to be connected to the exercise machine, wherein the plunger comprises a second lug connected to the coupler.

* * * * *